United States Patent [19]

Scheler

[11] Patent Number: 4,542,736

[45] Date of Patent: Sep. 24, 1985

[54] FIREPLACE CAP WITH PREHEATED SECONDARY AIR SUPPLY

[76] Inventor: Philip E. Scheler, Rte. 1, Western Heights, #12, Baker, Oreg. 97814

[21] Appl. No.: 682,337

[22] Filed: Dec. 17, 1984

Related U.S. Application Data

[63] Continuation-in-part of Ser. No. 452,025, Dec. 21, 1982, Pat. No. 4,508,098.

[51] Int. Cl.[4] ..... F24C 15/04

[52] U.S. Cl. ..... 126/139; 126/140; 126/202; 126/120

[58] Field of Search ..... 126/120, 139, 140, 143, 126/202; 160/77, DIG. 9; 126/121

[56] References Cited

U.S. PATENT DOCUMENTS

| | | | |
|---|---|---|---|
| 1,171,717 | 2/1916 | Haddox | D23/138.1 X |
| 1,832,592 | 11/1931 | Sweeley et al. | 49/319 |
| 1,919,986 | 7/1933 | Powers | 49/366 X |
| 2,258,882 | 10/1941 | Craig | 126/121 |
| 3,459,173 | 8/1969 | Lydle | 126/202 |
| 3,870,032 | 3/1975 | Lydle et al. | 126/202 |
| 3,913,558 | 10/1975 | Caldwell | 126/139 |
| 3,995,612 | 12/1976 | Dew | 126/139 |
| 4,029,076 | 6/1977 | Simington | 126/140 |
| 4,036,205 | 7/1977 | Hayes | 126/126 |
| 4,060,196 | 11/1977 | Goldsby et al. | 237/51 |
| 4,108,144 | 8/1978 | Wilhoite | 126/120 |
| 4,195,618 | 4/1980 | Kellogg et al. | 126/120 |
| 4,213,446 | 7/1980 | Stookey et al. | 126/192 |
| 4,214,570 | 7/1980 | Hansmeyer | 126/121 |
| 4,219,005 | 8/1980 | Boahn | 126/121 |
| 4,248,206 | 2/1981 | Orthey, Jr. | 126/143 |
| 4,263,889 | 4/1981 | Martenson | 126/123 |
| 4,265,213 | 5/1981 | Gorsuch et al. | 126/66 |
| 4,282,855 | 8/1981 | Perry | 126/121 |
| 4,319,558 | 3/1982 | Thurlo | 126/121 |
| 4,465,055 | 8/1984 | Bortz | 126/123 |

FOREIGN PATENT DOCUMENTS

| | | | |
|---|---|---|---|
| 658 | of 1902 | United Kingdom | 126/139 |

OTHER PUBLICATIONS

Brochure: Mt. Vernon Fireplaces, Inc., "Fireplace-Furnace, A Fully Automatic Thermostatically Controlled Central Heat . . . ".

Brochure: The Welenco Fireplace Insert/Heat Exchanger.

Brochure: Welenco, Regarding the Welenco Fireplace Heat Exchanger.

Brochure: Sweet Home Stove Works, Inc., The West's Leading Heat Source.

Brochure: Burning Log, "turbo 10", The Wood Fire with a Revolutionary Secondary Combustor.

Brochure: Kent-Tile, Unique Kent Design.

*Primary Examiner*—Samuel Scott

*Assistant Examiner*—Allen J. Flanigan

*Attorney, Agent, or Firm*—Klarquist, Sparkman, Campbell, Leigh & Whinston

[57] ABSTRACT

A fireplace cap is positioned outside the firebox of the fireplace. The cap has a framework comprised of first and second side members, an upper cross member and a lower damper section. A pair of hinged doors are mounted to this framework. Dampers selectively control the passage of primary combustion air directly to the firebox. A mantel overlies the upper cross member and a secondary air deflector baffle extends downwardly from the underside of the mantel. This baffle, together with the upper cross member, defines a transversely extending secondary air preheating chamber. Preheated air from the chamber is directed by the baffle across the doors prior to passing into the firebox. In one embodiment, secondary air enters the chamber through a space between the mantel and upper cross member. A valve controls the flow of secondary air to this space. In another embodiment, the damper section and side members define passageways which direct outside combustion air upwardly along the sides of the cap and into the chamber. Valves in the side passageways control the flow of air to the chamber.

21 Claims, 12 Drawing Figures

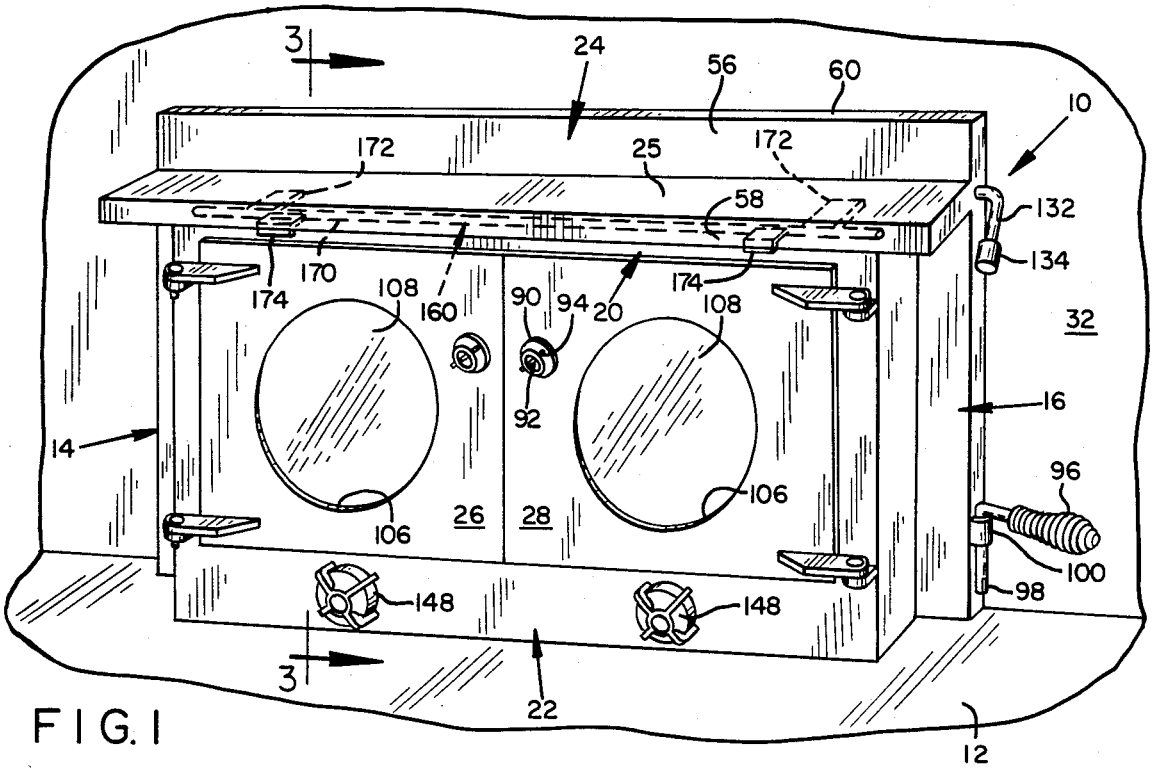
FIG. 1
FIG. 2
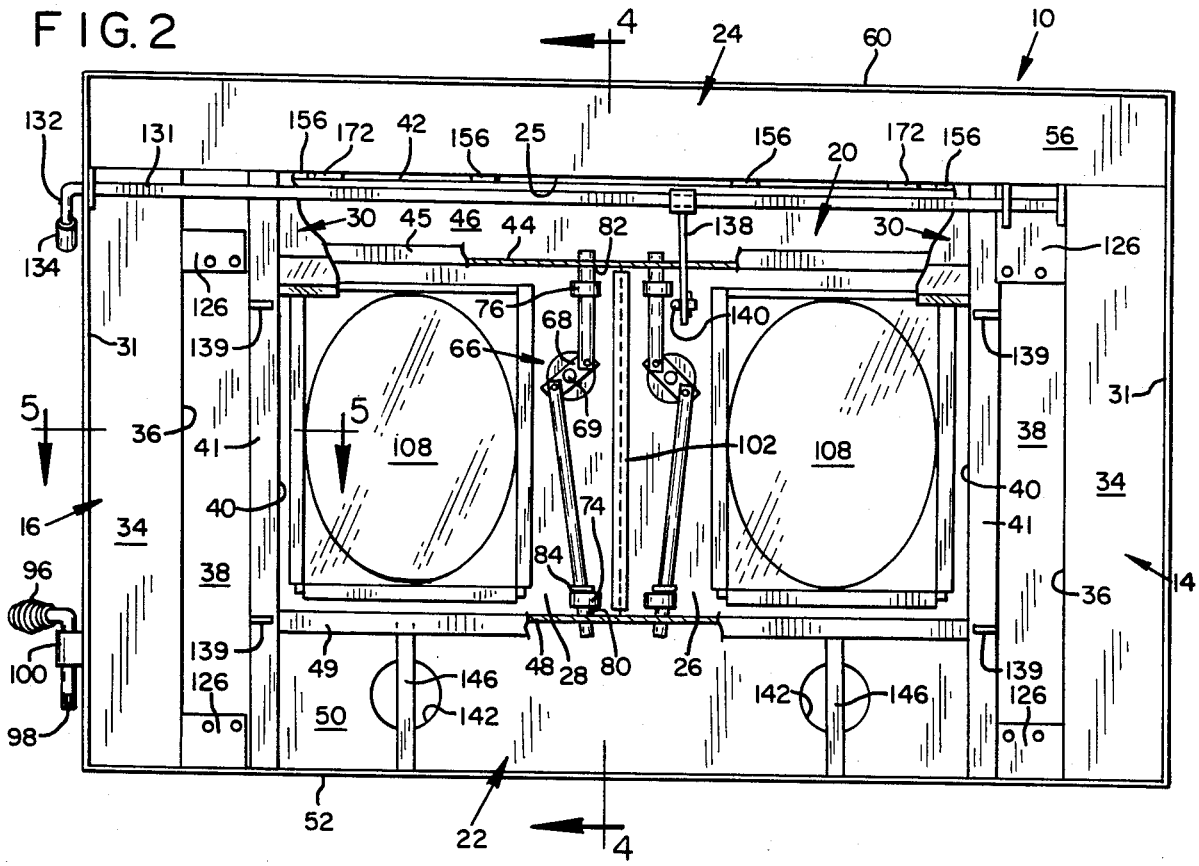

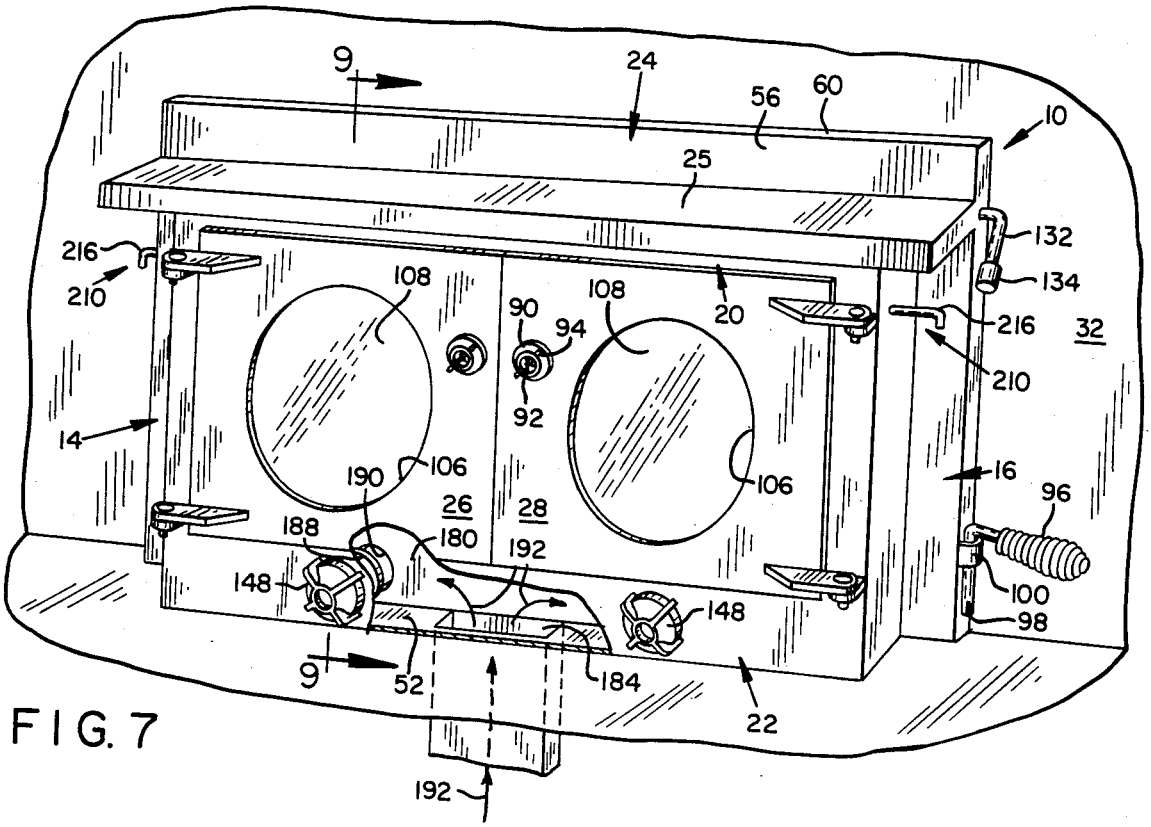
FIG. 7
FIG. 8
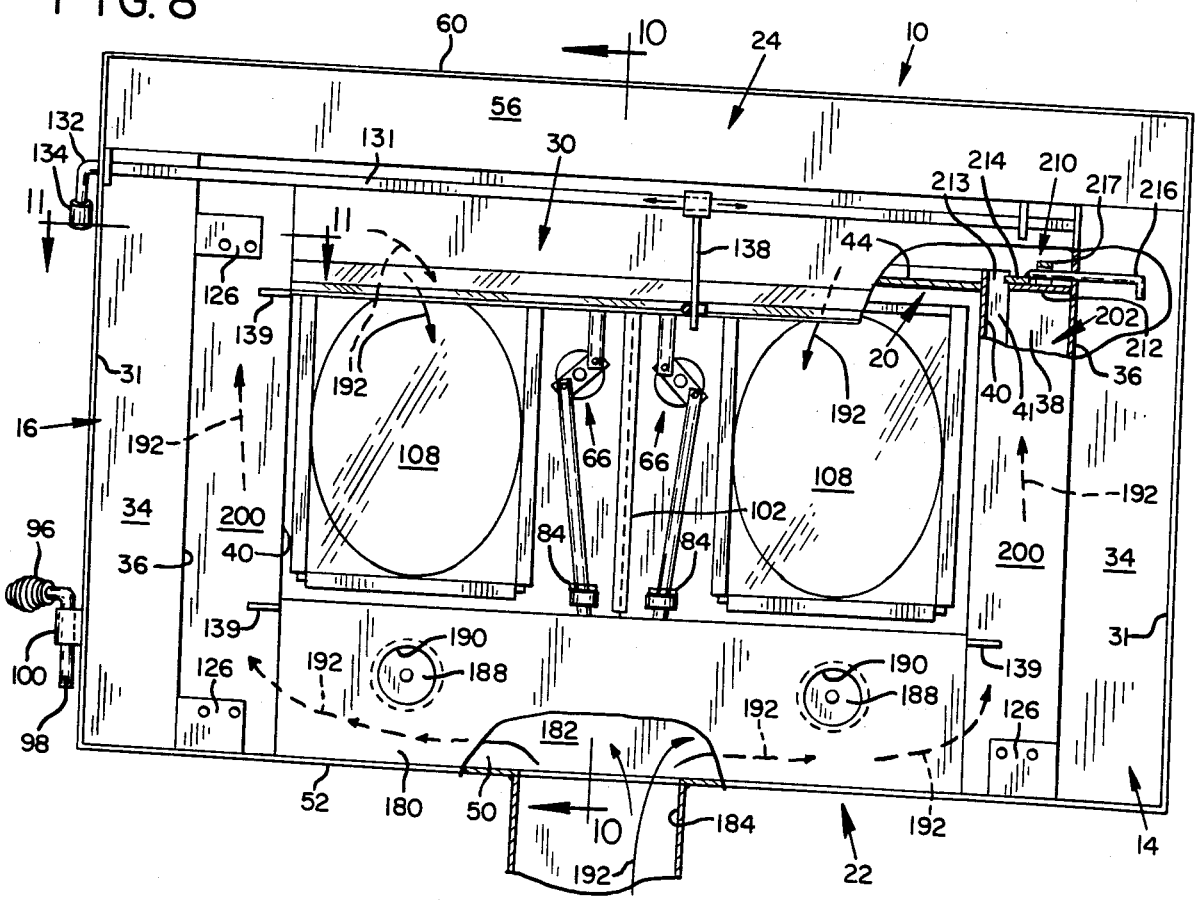

FIREPLACE CAP WITH PREHEATED SECONDARY AIR SUPPLY

CROSS REFERENCE TO RELATED APPLICATION

The present application is a continuation-in-part application of application Ser. No. 452,025 of Philip E. Scheler, filed Dec. 21, 1982, now U.S. Pat. No. 4,508,098, and entitled FIREPLACE CAP.

BACKGROUND OF THE INVENTION

The present invention relates to a front, or cap, for a fireplace, and more particularly to such a cap with a preheated secondary air supply.

Fireplace fronts, or caps, have heretofore been known. One such device is produced by Mt. Vernon Fireplaces, Inc. and has a front plate for covering a fireplace opening to which a pair of hinged doors are mounted. Glass panels are included in the doors to enable the user to view the fire within the fireplace after the device is installed. In addition, fireplace caps as described in the aforementioned application Ser. No. 452,025 of Scheler have been sold for more than one year prior to the filing date of the present application. This prior Scheler application also discloses a cap with hinged doors and which covers a fireplace opening.

Neither of these two caps are understood to provide secondary air, let alone preheated secondary air, to a fire within a firebox of a fireplace. In addition, neither of these devices are understood to control the flow of combustion air from outside the heated interior of a building to the firebox of the fireplace.

Another example of a fireplace front is disclosed in U.S. Pat. No. 3,459,173 of Lydle. In Lydle, air enters a chamber along the lower edge of the front. This air flows upwardly through flutes and along the back of glass doors of the front. As air passes along the glass, it sweeps the glass and cools it. A controller near the top of the Lydle front controls the flow of air into this lower chamber. Air entering the Lydle chamber is preheated somewhat before entering the firebox of a fireplace. However, Lydle is not understood to provide a secondary source of combustion air as all air supplied to the fireplace is understood to come from this lower chamber.

Although not a fireplace front, woodstoves are known which introduce combustion air into a chamber located in an upper front region of the stove and extending transversely between the sides of the stoves. One such stove is sold under the trademark KENT and has a chamber which is slotted along the length of its lower region. This permits the passage of air downwardly from the chamber and along the doors of the stove. This air then passes to fuel which is burning within the stove. In the KENT construction the chamber is formed of metal walls of uniform thickness throughout. Also, all combustion air for the KENT stove is understood to enter the firebox through this chamber.

Although these prior designs exist, there is nevertheless a need for an improved fireplace front which enhances the performance of the fireplace to which the front is mounted by introducing preheated secondary combustion air to the firebox of the fireplace.

SUMMARY OF THE INVENTION

The present invention comprises a fireplace cap which is positioned outside of the firebox of the fireplace. The cap covers and seals the fireplace opening to prevent room air from entering the fireplace, except as controlled by the cap. The cap includes a pair of hinged doors mounted to a surrounding framework which includes first and second side rail members, an upper cross rail section or member, and a lower damper section. A mantel along the upper surface of the fireplace front, and in the illustrated form overlies the upper cross rail. A secondary air deflector baffle means projects downwardly from the under side of the mantel and, together with the upper cross rail, defines a secondary air preheating chamber which extends transversely across the upper region of the fireplace front. Secondary air is supplied to the chamber from a secondary air inlet means under the control of secondary air valve means. Air exits downwardly from the secondary air chamber through an outlet means. In addition to the secondary air supply, primary combustion air supply control means is provided at a lower region of the fireplace front for selectively directing primary combustion air into the fireplace. Primary combustion air is typically directed into the fireplace while a fire is initially starting. Thereafter, the flow of primary combustion air is shut off and secondary preheated air from the preheating chamber is delivered to the firebox to support continued combustion within the firebox. This secondary air enhances the reburning of gases and other products of combustion in the firebox.

As another aspect of the present invention, the secondary air deflection baffle means projects below the secondary air outlet means and direct secondary air from the preheat chamber downwardly and along the interior surface of doors of the cap. This air helps to clean the doors and prior to reaching the fuel within the firebox of the fireplace.

As still another feature of the present invention, the secondary air deflector baffle means is of a relatively thin metal so as to enhance the rapid transfer of heat to secondary air entering the secondary air chamber.

In accordance with a first embodiment of the invention, the top surface of the upper cross rail section is spaced from the underside of the mantel so as to define an elongated secondary air inlet therebetween. The secondary air valve means comprises an elongated valve for selectively opening and closing the space between the mantel and upper cross rail. Also, damper controls are provided for selectively opening primary combustion air openings which communicate from the room being heated, through the lower damper section, and directly to the firebox of the fireplace.

In accordance with a second embodiment of the invention, the mantel and upper cross rail are in an abutting relationship. Furthermore, the lower damper section and first and second side rails are enclosed to define secondary air passageways therethrough. The lower damper passageway communicates with a lower region of each of the side rail passageways. In addition, the ends of the secondary air chamber communicate with upper regions of the respective side rail passageways. Each of the side rail passageways is provided with a secondary side passageway valve. These side passageway valves control the passage of air from the side rail air passageways to the secondary air preheating chamber. Outside combustion air is delivered through an opening to the lower damper passageway. With the first and second side valves open, this outside combustion air passes from the lower damper passageway, upwardly through the side rail passageways, and into the secondary air chamber. From the chamber, the secondary air passes, as previously described, to the interior of the fireplace. Thus, additional preheating of the secondary air takes place within the lower damper passageway and the side rail passageways prior to delivery to the upper secondary air chamber. Also, damper controls are provided for selectively opening primary combustion air openings which communicate directly from the lower damper passageway to the firebox of the fireplace. When these openings are open, outside combustion air flows directly from the damper passageway to the firebox.

Accordingly, it is an overall object of the present invention to provide an improved fireplace cap with a preheated secondary air supply.

It is still another object of the present invention to provide such a fireplace cap which enhances the reignition of products of combustion within a fireplace to thereby reduce pollution generated by the combustion of fuel within the firebox.

It is a further object of the present invention to provide a cap with the capability of selectively delivering primary combustion air to the firebox, preheated secondary air to the firebox, or a combination of primary and secondary air as desired.

It is still another object of the present invention to provide a cap which enhances the preheating of secondary air delivered to a fireplace.

Another object of the present invention is to deliver preheated secondary air to a fireplace in a manner which downwardly sweeps the doors of a fireplace cap.

A further object of the invention is to provide a cap which may be easily custom manufactured to fit the varying dimensions of fireplace openings with a minimum inventory of parts required for such custom manufacture.

Still another object of the invention is to provide a fireplace cap which is strong and durable, safe to use, easy to install, clean, and which is virtually maintenance-free.

A still further object of the invention is to provide a fireplace cap which enhances the functioning of an existing fireplace.

These and other objects, advantages and features of the present invention will become apparent with reference to the following description and drawings.

BRIEF DESCRIPTION OF THE DRAWINGS

FIG. 1 is a front isometric view of a fireplace cap in accordance with the invention;

FIG. 2 is a back elevational view of the fireplace cap of FIG. 1;

FIG. 7 is a front isometric view of an alternate embodiment of a fireplace cap in accordance with the present invention;

FIG. 8 is a back elevational view of the fireplace cap of FIG. 7;

DETAILED DESCRIPTION OF THE PREFERRED EMBODIMENTS

With reference to FIGS. 1 through 6, a first embodiment of the invention will be described. In particular, referring to FIG. 1, a fireplace cap 10, in accordance with the invention, is positioned on a hearth 12 outside of the firebox of a conventional masonry or other fireplace. Thus, the entire firebox is unobstructed by the cap and is available for use in burning fuel.

Figure 3:
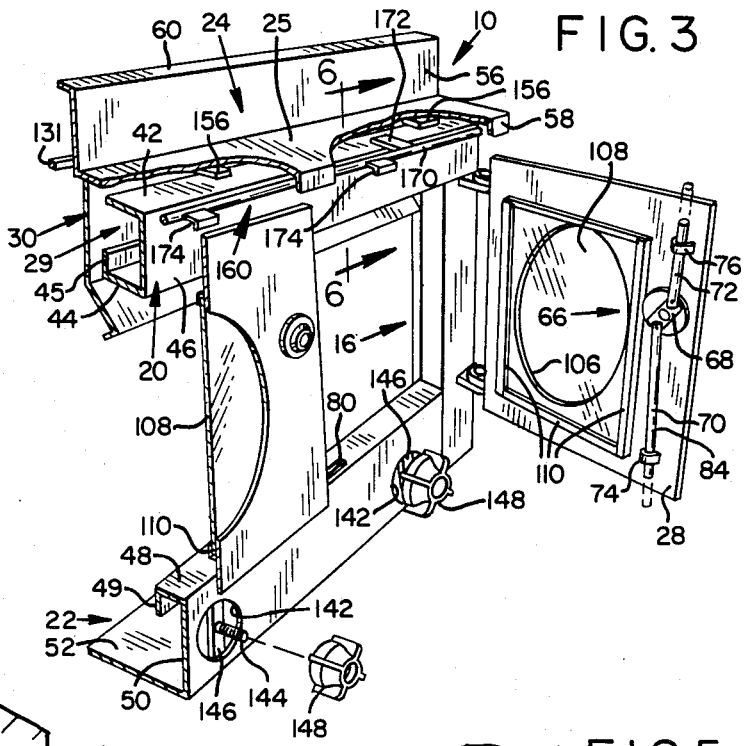
FIG. 3 is a front isometric view of the fireplace cap of FIG. 1, partially in section, taken along line 3—3 of FIG. 1.

As best seen in FIGS. 2 and 3, cap 10 includes a rectangular framework formed of four major components, including first and second upright side rails 14, 16, a header section or cross rail 20 interconnecting the upper ends of the side rails, and a lower damper section 22 interconnecting the lower ends of the side rails. These components define a fireplace cap opening through which access to the firebox is provided. An elongated top piece 24 overlies the header. The side rails 14, 16, header cross rail 20, and damper section 22 are preferably of a strong, durable heat-conducting material, such as of a heavy gauge steel which is formed or bent into angular shape. Few weld seams are required to join these members. This minimization of welds adds extra strength to the cap. A pair of doors 26, 28 are hinged to the respective side rails 14, 16 for selective access to the interior of the firebox of the fireplace.

The side rails, damper section and upper cross rail may take a number of configurations. However, in accordance with the present invention, in each of these configurations a secondary air preheat chamber 29 is provided along an upper region of the fireplace cap 10 (see, for example, FIG. 3). In the illustrated embodiment, preheat chamber 29 is defined by the upper cross rail section 20 and a secondary air deflection baffle 30, which projects downwardly from the underside of a mantel or cooking shelf 25 of the top piece 24. The functioning of this preheat chamber 29 will be described in greater detail below. Thus, although a number of configurations are possible, the form illustrated in FIGS. 1 through 6 will next be described in greater detail.

Figure 5:
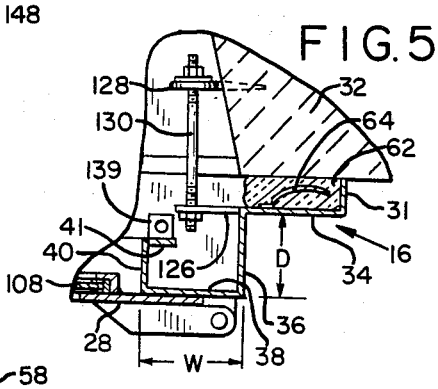
FIG. 5 is a cross-sectional view through a side rail member of the fireplace cap of FIG. 1 taken along line 5—5 of FIG. 2.
Figure 9:
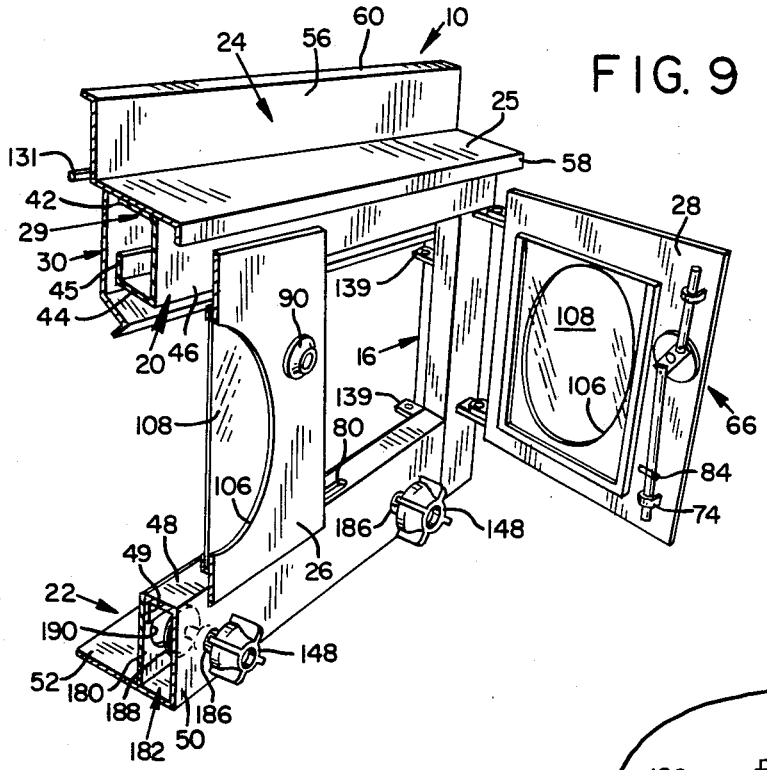
FIG. 9 is a front isometric view of the fireplace cap of FIG. 7, partially in section, taken along line 9—9 of FIG. 7.
Figure 10:
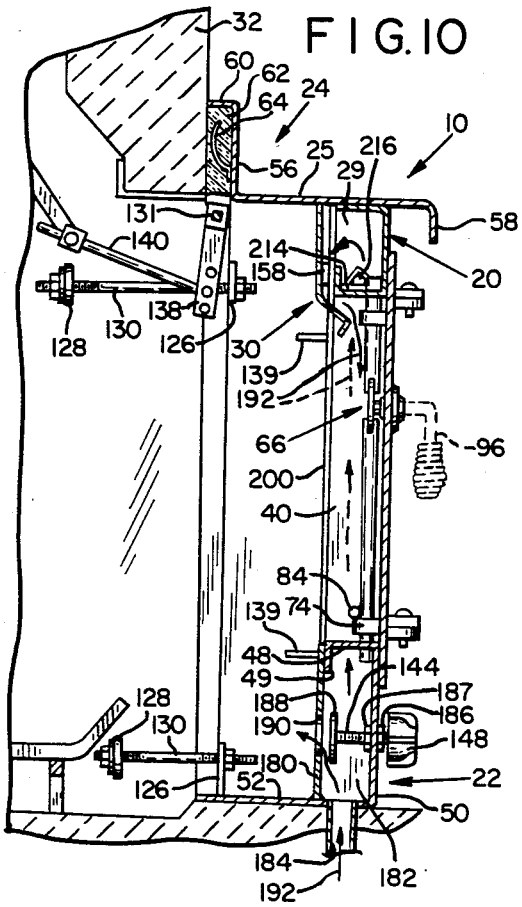
FIG. 10 is a cross-sectional view of an installed fireplace cap of FIG. 7, taken along line 10—10 of FIG. 8.

The side rails 14, 16 have an identical cross section as shown in FIG. 5. More specifically, side rail 16 includes a first upright flange portion 31. This flange 31 is laterally spaced from the fireplace opening and extends outwardly away from the masonry 32 of the fireplace, with an upright edge of the flange abutting the masonry when the cap is installed. The side rail 16 bends through a ninety-degree angle from flange 31 to form a first step 34. This step 34 parallels the masonry and, together with flange 31, forms a sealing material receiving pocket in which heat-resistant fiber or other material 62 is positioned to seal the gap between the side rail and fireplace. Retainers, such as plural wires 64, spot-welded or otherwise mounted to the back side and along the length of step 34, impale the sealing material and hold it in place. From step 34, the side rail turns outwardly through a ninety-degree angle to a riser portion 36 of a width or depth D. The riser portion parallels the first flange 31. From riser portion 36, the rail bends inwardly through an additional ninety-degree angle to form a second step 38 having a width W. This second steps covers a portion of the fireplace opening. In addition, the side rail bends through still another ninety-degree angle to form a reinforcing flange 40 which extends toward the fireplace. Finally, the side rail bends through still another ninety-degree angle to provide a rib 41 extends from rib 40 toward riser portion 36. This rib 41 bounds the side margins of the cap opening.

Figure 6:
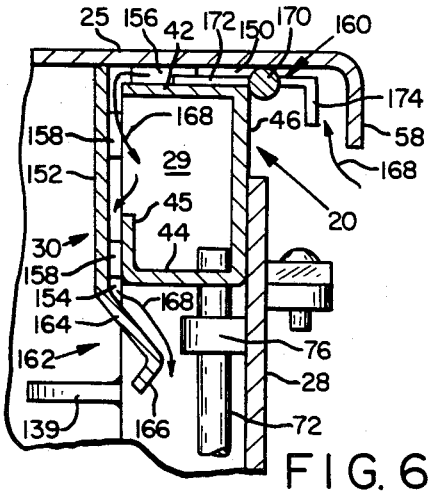
FIG. 6 is an enlarged sectional view of the secondary air chamber and secondary air deflection baffle portion of the fireplace cap of FIG. 7, taken along lines 6—6 of FIG. 3.

Referring to FIG. 6, the header section 20 comprises a channel with respective upper and lower horizontal header section legs 42, 44, a vertical reinforcing flange 45 projecting upwardly from header section leg 44, and a vertical header section face 46. In addition, with reference to FIGS. 3 and 4, the damper section 22 is also generally channel-shaped with an upper horizontal damper section leg 48, a vertical reinforcing flange 49 projecting downwardly from damper section leg 48, a vertical damper section face 50, and a lower horizontal damper section leg 52. Leg 52 may be of one piece or comprise a flange of the same width as damper section leg 48, to which a filler plate is welded. The lower damper section leg 52 is relatively wide to provide a broad base for supporting the cap. Sealing material (not shown) may be placed under leg 52 for sealing purposes. Header cross rail leg 44 bounds the upper margin of the cap opening while damper section leg 48 bounds the lower margin of the cap opening. Therefore, a continuous rib, including the side rail flanges 40 and legs 44, 48, surrounds and reinforces the cap opening. Reinforcing is also provided by the flanges 41, 45, and 49.

Figure 4:
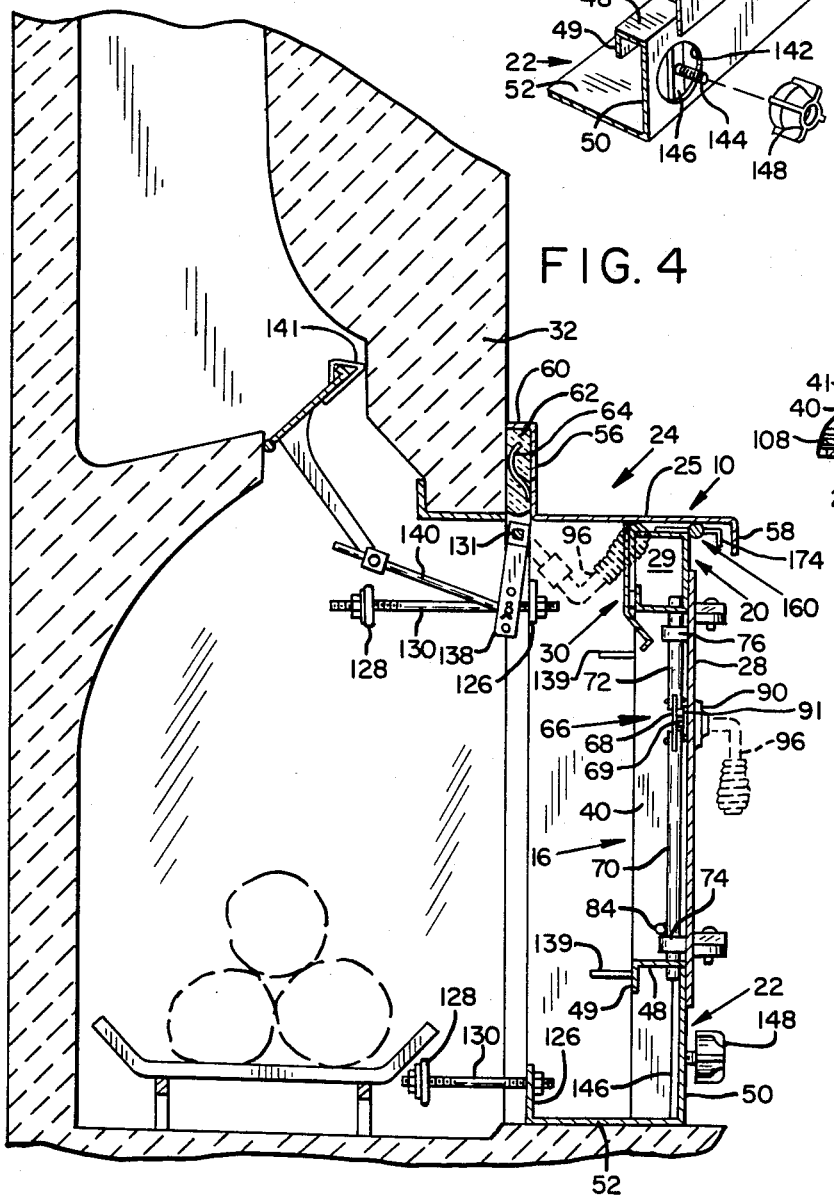
FIG. 4 is a cross-sectional view of an installed fireplace cap of FIG. 1 taken along line 4—4 of FIG. 2.

In addition, the top piece 24 is of right-angular construction, with the horizontal mantel 25 and a vertical back portion 56. A down-turned flange 58 is provided along the front edge of the mantel 25 while a rearwardly extending flange 60 is positioned along the upper edge of the back section 56. Flange 60 abuts the fireplace masonry above the fireplace opening. As best seen in FIG. 4, back section 56 and flange 60 define a sealing material receiving pocket within which sealing material 62 is retained to seal the top of the cap.

With components shaped as described above, the construction of the cap is more efficient, economical, and requires a minimum inventory of components to custom manufacture caps for fireplaces with various sized fireplace openings. That is, the doors 26, 28 are a standard size for all caps so that only one door size is required. In addition, side rails are inventoried with varying depths D and widths W, together with top pieces 24, header sections 20, and damper sections 22 of appropriate lengths. Consequently, given the dimensions of a fireplace opening, the desired components may be readily selected and assembled to fit the customer's fireplace.

The strength of the unit is enhanced, due to the rigid angular construction of the components. The heat transfer characteristics of the cap are also improved due to the light gauge metal utilized in the preferred embodiment. Also, the cap is more efficient in recovering heat from fuel burned in the fire box because of the various ribs and flanges which project from the back side of the cap toward the fire box. These ribs and flanges absorb heat from the fire, resulting in increased heat being radiated into the room from the burning fuel. Also, heat from the fire is stored in the mass of the fireplace masonry and radiated into the room containing the fireplace.

A latching mechanism 66 is provided to tightly seal and hold the doors 26, 28 closed. An identical mechanism is provided for each door and will be described for door 28, with reference to FIGS. 2 and 4. The latching mechanism 66 includes an actuator having a plate 68 pivoted by a cylinder or pipe 69 to the door 28. Respective upper and lower latching arms 70, 72 are eccentrically and pivotally mounted to the plate 68. The lower arm 70 extends through a cylindrical guide 74 mounted to the back side of the door while the upper arm 72 extends through a similar guide 76. When the doors are latched, as shown in FIG. 2, the arm 70 extends through an opening 80 in the damper section leg 48. At the same time, upper arm 72 extends through an opening 82 in the header section leg 44. A stop 84 is mounted to the lower end of lower arm 70. This stop engages the guide 74 and limits the maximum extension of the latching arms to prevent over-centering and binding of the latching mechanism.

The actuator includes a front bearing or actuator portion 90 (FIGS. 1 and 4) mounted to cylinder 69 at the front side of the door 28. In addition, the actuator includes a rear bearing or actuator portion 91 (FIG. 4) mounted to cylinder 69 at the rear side of the door. In the preferred embodiment, bearing portion 90 comprises a disc with a bore 92, across which a pin 94 extends. A removable key or handle 96, having a slot 98, is utilized to operate bearing portion 90 and the latching mechanism. That is, the handle 96 is positioned with the pin 92 in the slot 98 and then pivoted in one direction to retract the latching arms to permit the doors to open. The handle is pivoted in the opposite direction to extend the latching arms to hold the doors closed. When not in use, the handle is inserted within a cylindrical sleeve 100 mounted to side rail 16 where it will not get hot. In addition, the handle may be placed in a hard-to-reach location so that children cannot use the handle to open the doors when a fire is burning.

With this door closure mechanism, the doors are tightly sealed when closed. The guides 74, 76 may be bent to eliminate any free play in the doors when latched. This adjustment feature helps insure a tight fit of the doors when closed. Also, a vertical lip is provided by a strip 102 mounted to the vertical free edge of door 26. This lip bears against the door 28 when the doors are closed to seal the crack between the doors.

In addition, optional window openings 106 (FIG. 1) may be provided in the respective doors 26, 28. A transparent heat-resistant panel or pane 108, such as ceramic glass, covers the openings 106 so that fire within the fire box may be viewed. As shown in FIG. 3, right angular members 110 are mounted to the inside of the doors along the respective sides and bottom of the window opening 106. The glass is then slid downwardly into slots defined by these angled members, so that the panel is held in place. The panel can easily be removed by lifting it upwardly for repair purposes. In addition, a heat-resistant material, such as woven fiberglass, is adhesively secured to the four edges of the glass. This provides an airtight seal and cushion between the glass and door. The angular members 110 protect this heat resistant material. In addition, a flat bar (not shown) may be provided between the upper ends of the side members 110 to overlie and protect heat resistant material mounted to the upper edge of the glass.

For installation purposes, brackets 126 (see FIG. 2) are mounted to the framework of the cap. Eye bolts 128 are lagged into the masonry or steel at the inside of the fire box of the fireplace. Threaded rods 130 extend through the brackets 126 and eye bolts 128. Nuts on the rods 130 are then tightened to draw the cap snugly against the front of the fireplace.

The apparatus also includes an external control for operating a conventional damper of the fireplace. With reference to FIGS. 1 and 2, this control comprises a rod with a first horizontal section 131 passing through side rail 16, positioned above the doors 26, 28, and pivotally mounted to the framework. The rod section 131 is bent where it emerges from the cap to form a lever section 132 which terminates in a socket 134. The socket 134 is adapted to receive the handle 96 for operating the lever to rotate the rod. A damper actuating arm 138 is slidably mounted to rod section 134 and projects outwardly therefrom. An elongated pin 140 (FIG. 4) is utilized to couple the actuating arm 138 to the fireplace damper. When the lever section 132 is pivoted, rod section 131 and actuating arm 138 pivot to open and close the damper. Thus, the damper is operable from outside the firebox. Also, a clip 141 (FIG. 4) is secured to the damper to prevent it from closing completely. Therefore, at all times, a path is provided for the egress of products of combustion past the damper and to the chimney.

Brackets 139 may be welded to one or both of the ribs 41 for supporting barbeque grills, pots, and the like within the fireplace. Thus, in conjunction with the cooking surface or mantel 25 of the top piece 24, the cap may function as a cook stove and barbeque, as desired.

In the embodiment of FIG. 1, a pair of damper openings 142 (FIGS. 2 and 3) are provided through the damper face section 50 of the damper section 22. A threaded bolt 144 projects outwardly through these openings 142 from a bar 146 welded to the inside of the damper face section. A damper control knob 148 is threadedly mounted to the bolt 144. Control knob 148 may be rotated to close the opening 142 completely, or to open it, as desired.

With reference to FIGS. 3 and 6, as previously mentioned, the secondary air deflector baffle 30 extends downwardly from the underside of the mantel 25 and, together with the upper cross rail 20, defines the secondary air preheating chamber 29 along the upper region of the fireplace front. In addition, the mantel 25 and upper flange 42 of the cross rail 20 are spaced apart, approximately by one-quarter of an inch. This provides a secondary air inlet slot 150 between members 42 and 25 which leads to the chamber 29. Also, the secondary air deflector baffle 30 extends transversely between the two side rails 14, 16. Baffle 30 includes a first downwardly projecting vertical plate portion 152, which is spaced from the end of the flange 42 and the rib 45 of the header cross rail 20 by approximately one-quarter of an inch. As a result, an elongated secondary air outlet slot 154 is provided between rib 45 and baffle 30 through which preheated secondary air exits from the chamber 29 to the firebox.

Spacers 156 (FIGS. 2, 3 and 6) maintain the separation between the mantel 25 and section 42 of the upper cross rail. These spacers also rigidly interconnect these members. Similar spacers 158 are provided to maintain the spacing between the deflector baffle section 152 and the cross rail 20.

Also, the lower free-end portion of the secondary air deflector 30, designated by the number 162 in FIG. 6, that is, the portion of the baffle 30 below the outlet 154, includes first and second sections 164, 166. The baffle section 164 angles downwardly toward the doors from the lower margin of deflector section 152, and thus from outlet 154. In the illustrated form, baffle section 164 is angled at approximately forty-five degrees from vertical. Preheated secondary air from the chamber 29 is directed by the baffle section 164 downwardly and along the interior surface of the doors before the secondary air turns and flows to fuel in the firebox. This downwardly directed secondary air sweeps the doors to reduce the buildup of creosote and other materials on the interior surfaces of the doors. Also, the baffle section 166 angles toward the firebox of the fireplace from the lower margin of baffle section 164. Baffle section 166 is also at approximately forty-five degrees from vertical.

With the illustrated configuration, the secondary air deflector baffle 30 restricts the reverse flow of smoke and other products of combustion from the firebox, through outlet 154, chamber 29, and inlet 150 to a room or other space outside of the cap 10. Also, with valve 160 open, air flows generally as indicated by arrows 168 through the secondary air preheat chamber 29 and from the chamber to the fireplace.

In the preferred embodiment, secondary air deflector baffle 30 is of a relatively thin metal in comparison to the metal used for the cross rails. For example, baffle 30 may be of sixteen gauge steel. With this thin construction, the transfer of heat through the baffle to secondary combustion air entering the chamber 29 is enhanced. The heating of air within chamber 29 is also enhanced because of the position of chamber 29 along an upper region of the fireplace front and the upward radiation of heat from the fuel in the firebox. In addition, further heating of the secondary air takes place as the secondary air passes downwardly along the doors prior to the passage of the secondary air to the fuel region of the firebox.

The preheated secondary air combines with hot gases and products of combustion above the fuel. This causes these gases and products of combustion to reignite and thereby increases the heating efficiency of the fireplace. In addition, by reigniting such gases and products of combustion, pollution from the fireplace is reduced. Typically, temperatures on the order of one thousand degrees Fahrenheit or higher are required to reignite these gases. The achievement of these temperatures is enhanced by the present invention because of the effective preheating of the secondary air before it reaches the fuel region of the fireplace.

In accordance with an optional aspect of the present invention, the spacers 158 (FIG. 6), positioned between baffle section 152 and cross rail section 45, may be elongated to seal the outlet 154 except through narrow slots centered above each of the doors. For example, these slots may be limited to seven inches in length. By restricting the outlet 154 in this manner, air pressure in chamber 29 increases slightly. This increases the velocity of secondary air exiting through the outlet slots. Due to this increased velocity, enhanced cleaning of the doors results. In addition, the increased velocity also increases the turbulence of the secondary air entering the firebox. This turbulence facilitates the reignition of the products of combustion.

As shown in FIG. 3, the illustrated valve 160 includes an elongated rod 170 of a diameter greater than the height of slot 150. Valve guiding flanges 172 projecting from the rod 170 inwardly into the space between the mantel 25 and upper cross rail section 42 (see FIG. 6). Flanges 172 prevent the valve from falling out of the slot 150. In addition, handles 174 project outwardly from the valve rod 170. These handles are positioned for easy access by simply reaching underneath the overhanging lip 58 of the mantel.

As explained below, in connection with the operation of a cap of this construction, air may pass directly to the firebox through the openings 142 when knob 148 is turned to open these openings. Typically, air is supplied directly in this manner at times when a fire is first started. After a fire is burning, the openings 142 are typically closed and valve 160 is opened. As a result, preheated secondary air is supplied to fuel within the firebox from the preheat chamber 29.

An alternate embodiment of the invention is illustrated in FIGS. 7 through 12. Common elements between the first and second embodiments have been labeled with common numbers. Therefore, further discussion of these common elements is unnecessary. In accordance with this second embodiment of the invention, the slot 150 leading to the secondary air chamber 29 has been eliminated. This is accomplished by positioning the underside of the mantel 25 in abutting relationship with the flange 42 of the upper cross rail section 20 (see FIG. 9). Furthermore, the lower damper section 22 is closed by a plate 180 to provide a damper section passageway 182. That is, plate 180 is welded along its lower edge to the plate 52, extends vertically upwardly, and is welded along its upper edge margin to the rib 49. A combustion air supply passageway 184 communicates through the plate 52 and with the damper passageway 182. The air supply openings 142 through the damper face 50 have been eliminated in this embodiment. Instead, rods 144 are threadedly passed through nuts 186, 187 welded to opposite sides of damper face 50. An air flow control plate 188 is mounted to the end of each of the rods 144. Also, primary combustion air supply openings 190 are provided through the plate 180 at positions alighed with and adjacent to the air flow control plates 188. With this construction, rotation of knobs 148 in one direction shifts the flow control plates 188 toward the openings 190 and closes the openings. Furthermore, the control plates 188 may be positioned tightly against the plate 180 to completely close the openings 190 if desired. Conversely, rotation of the knobs 148 in the opposite direction shifts the control plates 188 away from plate 180 and opens the openings 190. When open, primary combustion air, for example from outside the structure being heated, passes upwardly through the passageway 184, through the damper section enclosure 188 and opening 190 to fuel in the firebox. Typically, the openings 190 are opened at times when a fire is first started.

Figure 11:
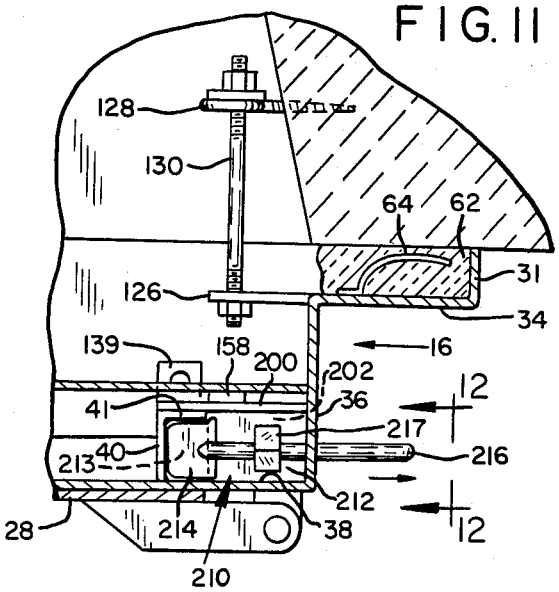
FIG. 11 is a cross-sectional view taken along line 11—11 of FIG. 8, showing one form of a side rail secondary air supply valve in accordance with the invention.
Figure 12:
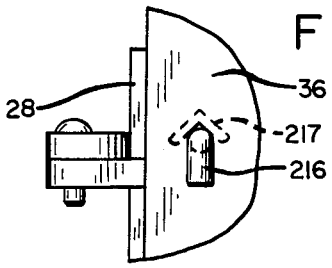
FIG. 12 is a side elevational view of a portion of the fireplace cap of FIG. 7, taken along line 12—12 of FIG. 11.

Referring to FIG. 11, each of the side rails 14, 16 are also closed by a plate 200 to provide a secondary air passageway 202 (see also FIG. 8). Each plate 200 is vertical and is fastened along one edge to the riser 36 of the associated side rail. The other edge of plate 200 is secured to the outer surface of the rib 41 of the associated side rail. The lower damper passageway 182 communicates with a lower region of each of the side passageways. In addition, the ends of the secondary air chamber 29 communicates with upper regions of the respective side passageways. Therefore, as indicated in FIG. 8 by arrows 192, outside secondary air entering the damper enclosure 182 passes through the damper passageway in opposite directions to the respective side passageways. Secondary air entering the side passageways flows upwardly and enters the ends of the chamber 29 for subsequent delivery from the chamber to the firebox as previously described in connection with the first embodiment of the invention.

Each of the side passageways is provided with a secondary air valve 210 for controlling the passage of the air therethrough, and thus from the damper passageway 182 to the secondary air preheat chamber 29. As shown in FIGS. 8 and 11, valves 210 include a fixed plate 212, which extends partially across the area of the side rail enclosure, leaving an unblocked space 213 through which the passage of secondary air is permitted. A movable valve plate 214 is slidably supported on fixed plate 214 and is connected to an acutator rod 216 which projects outwardly from the cap. When the rod 216 is slid inwardly, the movable valve plate 214 is shifted to closed positions which block all or portions of the unblocked space 213. The fully closed position is shown in FIG. 11. In contrast, when the rod 216 is pulled outwardly, the valve plate 214 is shifted to open positions, such as shown in FIG. 8. When the valves 210 are open, secondary air passes from the side rail passageways 202, past the valves 210, and into the preheat chamber.

The valves 210 are positioned along an upper region of the side rail passageways, approximately at the level of the upper edge of the door opening. This positions the rods 216 at locations where they are readily accessible without stooping. In addition, with the valves positioned at this upper location, a column of preheated secondary air is stored in the side rail passageways and is available as needed upon opening of the valves.

Also, as can be seen in FIG. 11, in the illustrated embodiment, the valve plates 214 do not tightly close the spaces 213. Instead, the valve plates 214 are designed to permit leakage of air past the valve plates even when the valves 210 are closed. This allows some preheated air to be drawn past the valves to maintain the fire in the fireplace.

A small section of angle iron 217 (FIG. 12) is inverted and positioned on fixed plate 212 to abut the rod 216 as the rod slides. This angle iron guides the motion of the rod and thus of the valve plate 214. In addition, the edges of valve plates 214 are rounded so that they do not catch the ends of the flanges 41 with the side passageways.

With the construction of FIG. 2, the flow of outside combustion air to the firebox is controlled for flow either directly from the damper section passageway 182 to fuel in the firebox, or through the side rail passageways to the preheat chamber 29 and thence to the firebox.

The typical operation of the caps 10 is as follows. To start a fire, the chimney damper is completely opened and the secondary air valves 160, or 210, are closed. In addition, the combustion air damper openings 142, or 190, are opened to permit the flow of combustion air directly to the firebox from the lower damper section. The doors 26, 28 are also opened and fuel is placed in the fireplace and lit. After the fire is lit, the doors are closed and the openings 142, or 190, are closed somewhat, but not entirely, until a good bed of coals is established.

After the coals are present, the chimney damper is closed. The clip 141 holds the chimney damper slightly open to permit the continuous egress of products of combustion out through the chimney. In addition, the secondary air supply valves 160, or 210, are opened completely. These valves admit enough oxygen to maintain the coal bed. In addition, sufficient preheated air is delivered to fuel in the firebox to facilitate the reignition of smoke and gases in the firebox.

If desired, for example to bank a fire over night, the secondary air supply valves 160, or 210, may be partially closed to retard the combustion of fuel in the firebox.

To add fuel to the firebox, the chimney damper is opened to vent gases from the fireplace. Thereafter, the doors 26, 28 are opened and fuel is added. Then, the doors are closed.

In accordance with the present invention, caps 10 allow enough heat to escape through the chimney to maintain the temperature therein in the range of typically from two hundred to five hundred degrees Fahrenheit. This minimizes the condensation of smoke and gases within the chimney which otherwise tend to form undesired creosote therein.

With the above construction, it is apparent that the control of air to fuel in the firebox may be easily and conveniently controlled. Furthermore, independent controls are provided for selectively delivering primary combustion air to a lower region of the firebox, for example during the initial startup of a fire. In addition, as desired, the direct supply of primary combustion air may be throttled down while the flow of secondary air to a preheat air chamber is independently controlled.

Having illustrated and described the principles of my invention with reference to several preferred embodiments, it should be apparent to those persons skilled in the art that such invention may be modified in arrangement and detail without departing from such principles. I claim as my invention all such modifications as come within the true spirit and scope of the following claims.

I claim:

1. A fireplace cap for a fireplace with a firebox and a fireplace opening leading to the firebox comprising:

an upright frame means having first and second side members, a lower damper cross member and an upper header cross member, said frame means defining a fireplace cap opening and being adapted for mounting to the front of a fireplace so as to permit insertion of fuel through the cap and fireplace opening and into the firebox of the fireplace;

at least one door mounted to the frame means and movable from a first position closing the cap opening to second positions opening the cap opening;

latching means for selectively holding the door in a closed position;

secondary air preheat chamber means extending transversely across an upper region of the cap and above the door, the secondary air preheat chamber means having secondary air inlet means for receiving secondary air and secondary air outlet means communicating with the firebox of the fireplace for delivery of preheated secondary air from the secondary air preheat chamber means to the firebox;

secondary air valve means for controlling the flow of secondary air through the secondary air chamber means; and primary combustion air supply means for selectively delivering primary combustion air therethrough to a lower region of the firebox.

2. A fireplace cap according to claim 1 in which the upper header cross member is hollow and has an interior which opens to and defines a portion of the secondary air preheat chamber means, the cap including mantel means extending from the upper header cross member toward the front of the fireplace when the cap is installed, secondary air baffle means projecting downwardly from the mantel means and extending transversely across the interior of the cap adjacent to and spaced from the upper header cross member, the secondary air baffle means defining a section of the secondary air preheat chamber means, the secondary air outlet means comprising a lower portion of the upper header cross member and an adjacent portion of the secondary air baffle means which define a secondary air outlet therebetween through which preheated secondary air is delivered from the secondary air preheat chamber means to the firebox.

3. A fireplace cap according to claim 2 in which the secondary air deflection baffle means is of reduced thickness relative to the thickness of the material forming the upper header cross member so as to enhance the heat transfer through the secondary air deflection baffle means to the secondary air preheat chamber means.

4. A fireplace cap according to claim 2 in which the secondary air deflection baffle means includes a lower transversely extending air deflection portion extending below the secondary air outlet, the lower air deflection portion including a first section angled downwardly from the secondary air outlet toward the door so as to direct secondary air from the secondary air preheat chamber along the interior surface of the door for cleaning the door.

5. A fireplace cap according to claim 4 in which the lower air deflection portion includes a second section projecting from a lower edge of the first section and away from the door.

6. A fireplace cap according to claim 5 in which the secondary air deflection baffle means has a vertical plate section exending downwardly from the mantel means to the secondary air outlet means, the first section of the lower air deflection portion being angled toward the door from the lower edge of the vertical plate section at an angle of approximately forty-five degrees from vertical, and the second section of the lower air deflection portion being angled away from the door at approximately forty-five degrees from vertical.

7. A fireplace cap according to claim 2 in which the mantel means overlies and is spaced above the upper header cross member so as to provide an elongated secondary air inlet between the mantel means and upper header cross member, the secondary air valve means comprising an elongated sliding valve positioned to selectively open and close the secondary air inlet.

8. A fireplace cap according to claim 7 in which the secondary air valve means comprises an elongated rod of a cross section which is greater than the height of the space between the mantel means and upper header cross member, the rod having flanges projecting therefrom and into such space and handles projecting outwardly from the rod away from the space such that the handles may be gripped to slide the rod and thereby control the secondary air valve means.

9. A fireplace cap according to claim 1 in which at least one of the side members defines an enclosed secondary air side passageway which communicates at an upper region thereof with the secondary air preheat chamber and at a lower region thereof with a source of secondary air so as to permit the passage of secondary air upwardly through the secondary air side passageway to the secondary air preheat chamber means.

10. A fireplace cap according to claim 9, including means for delivering outside combustion air to the lower region of the secondary air side passageway.

11. A fireplace cap according to claim 9 in which the secondary air valve means is positioned within the secondary air side passageway for controlling the passage of air therethrough.

12. A fireplace cap according to claim 11 in which the secondary air valve means is positioned in an upper region of the secondary air side passageway, such that, upon closure of the secondary air valve means, a column of secondary air is preheated within the secondary air side passageway.

13. A fireplace cap according to claim 11 in which the secondary air valve means permits leakage of air when closed.

14. A fireplace cap according to claim 11 in which the secondary air valve means comprises a fixed plate partially blocking the secondary air side passageway and leaving an unblocked passageway portion, a movable plate slidably supported for movement from a first position in which the unblocked passageway portion is substantially unobstructed by the movable plate to second positions in which the movable plate blocks all or portions of the unblocked passageway portion, and actuator means connected to the movable plate and projecting outwardly from the side member for sliding movement to shift the movable plate between positions.

15. A fireplace cap for a fireplace with a firebox and a fireplace opening leading to the firebox comprising:

an upright frame means having first and second hollow enclosed side members, each defining respective first and second secondary air side passageway therethrough;

a hollow enclosed lower damper cross member defining a damper passageway therethrough, the damper passageway communicating at a first end with a lower region of the first secondary air side passageway and at a second end with a lower region of the second secondary air side passageway, the lower damper passageway being coupled to a source of air when the cap is mounted to the fireplace, and an upper header cross member interconnected the side members;

said frame means defining a fireplace cap opening and being adapted for mounting to the front of a fireplace so as to permit insertion of fuel through the cap and fireplace openings and into the firebox of the fireplace;

at least one door mounted to the frame means and movable from a first position closing the cap opening to second positions opening the cap opening;

latching means for selectively holding a door in a closed position;

secondary air preheat chamber means extending transversely across an upper region of the cap and above the door, the secondary air preheat chamber means having secondary air inlet means communicating with upper regions of the first and second side air passageways for receiving secondary air from the source, through the damper passageway, and through the first and second side air passageways to the secondary air preheat chamber means, the secondary air preheat chamber means having a secondary air outlet means communicating with the firebox in the fireplace for delivery of preheated secondary air from the secondary air preheat chamber means to the firebox; and secondary air valve means for controlling the flow of secondary air to the secondary air preheat chamber means.

16. A fireplace cap according to claim 15 also including primary combustion air supply means for selectively delivering primary combustion air from the source to a lower region of the firebox, said primary combustion air supply means including primary air supply valve means for opening the damper passageway to the firebox to permit passage of primary combustion air directly to the firebox from the damper passageway.

17. A fireplace cap according to claim 15, in which the upper header cross member is hollow and opens inwardly toward the firebox, the interior of the upper header cross member defining a section of the secondary air preheat chamber means, the cap including a mantel means extending from the upper header section toward the front of the fireplace when the cap is installed, secondary air baffle means projecting downwardly from the mantel means and extending transversely across the interior of the cap adjacent to and spaced from the header cross member, the secondary air baffle means defining a section of the secondary air preheat chamber means, the secondary air outlet means comprising a lowermost transverse portion of the upper header cross member and the adjacent portion of the secondary air baffle means which together define a secondary air flow outlet opening therebetween, preheated secondary air being delivered from the secondary air preheat chamber means through this secondary air flow outlet opening and to the firebox;

the secondary air deflection baffle means including a lower transversely extending air deflection portion extending below the secondary air flow outlet, the lower air deflection portion including a first section angled downwardly from the secondary air flow outlet toward the door so as to direct secondary air from the secondary air preheat chamber means along the interior surface of the door for cleaning the door.

18. A fireplace cap according to claim 17, in which the secondary air valve means are positioned in an upper region of the respective secondary air side passageways.

19. A fireplace cap for a fireplace with a firebox and a fireplace opening leading to the firebox comprising:

an upright frame means having first and second side members, a lower damper cross member and an upper header cross member, said frame means defining a fireplace cap opening and being adapted for mounting to the front of a fireplace so as to permit insertion of fuel through the cap and fireplace opening and into the firebox of the fireplace;

at least one door mounted to the frame means and movable from a first position closing the cap opening to second positions opening the cap opening;

latching means for selectively holding the door in a closed position;

secondary air preheat chamber means extending transversely across an upper region of the cap and above the door, the secondary air preheat chamber means having secondary air inlet means for receiving secondary air and secondary air outlet means communicating with the firebox of the fireplace for delivery of preheated secondary air from the secondary air preheat chamber means to the firebox;

secondary air valve means for controlling the flow of secondary air through the secondary air chamber means;

the cap including mantel means extending from the upper header cross member toward the front of the fireplace when the cap is installed;

secondary air baffle means projecting downwardly from the mantel means and extending transversely across the interior of the cap adjacent to and spaced from the upper header cross member, the secondary air baffle means and upper header cross members together defining the secondary air preheat chamber means, the secondary air outlet means comprising a lowermost transverse portion of the upper header cross member and the adjacent portion of the secondary air baffle means which define a secondary air flow outlet opening therebetween through which preheated secondary air is delivered from the secondary air preheat chamber means to the firebox;

the mantel means overlying and being spaced above the upper header cross member so as to provide an elongated secondary air inlet between the mantel means and upper header cross member; and the secondary air valve means comprising an elongated sliding valve positioned to selectively open and close the secondary air inlet.

20. A fireplace cap according to claim 19 in which the secondary air valve means comprises an elongated rod of a cross section which is greater than the height of the secondary air inlet, the rod having flanges projecting therefrom and into such secondary air inlet, the rod also having handles projecting outwardly from the rod and away from the secondary inlet such that the handles may be gripped to slide the rod and control the flow of secondary air through the secondary air inlet to the secondary air preheat chamber means.

21. A fireplace cap according to claim 19, including primary combustion air supply means for selectively delivering primary combustion air therethrough to a lower region of the firebox.

* * * * *